United States Patent [19]

Lokshin et al.

[11] 4,003,441

[45] Jan. 18, 1977

[54] METHOD OF OPENING CARBON-BEARING BEDS WITH PRODUCTION WELLS FOR UNDERGROUND GASIFICATION

[76] Inventors: Efim Lvovich Lokshin, ulitsa Zheleznodorozhnaya, 30, kv. 30, Zagorsk Moskovskoi oblasti; Alfei Fedorovich Volk, ulitsa Kropotkinskaya, 40, kv. 14; Anatoly Antonovich Starinsky, 1 Golutvinsky pereulok, 21, kv. 29, both of Moscow, all of U.S.S.R.

[22] Filed: Apr. 22, 1975

[21] Appl. No.: 570,494

[52] U.S. Cl. ..... 175/71; 166/254; 175/65; 166/285

[51] Int. Cl.[2] ..... E21B 21/00; E21B 33/14; E21B 47/04

[58] Field of Search ..... 175/57, 65, 71, 40; 166/250, 254, 252, 268, 285

[56] References Cited

UNITED STATES PATENTS

| | | | |
|---|---|---|---|
| 1,978,668 | 10/1934 | Burg | 166/254 X |
| 2,158,198 | 5/1939 | Prescott | 166/254 UX |
| 3,172,487 | 3/1965 | Klotz | 175/71 X |
| 3,331,438 | 7/1967 | Slusser | 166/285 X |
| 3,380,532 | 4/1968 | Cook | 175/57 X |

*Primary Examiner*—Stephen J. Novosad

[57] ABSTRACT

Disclosed is a method of opening carbon-bearing beds with production wells for underground gasification wherein a production well is drilled until the top of a bed is opened up. As soon as the drilling tool enters the upper layer of the bed, the drilling is ceased and the depths of both the top and bottom of the bed are determined. Next, the drilling is resumed so as to leave a pillar of the bed at a depth where the possibility of communication between the adjacent wells by means of a fluid is assured through the bulk of the bed. On fitting a string of casing pipes in the well, the drilling of the pillar left between the shoe of the casing pipe string and the bottom of the bed goes on.

Unlike the known methods, the method disclosed assures the possibility of drilling production wells in a single run without unnecessary lowering and lifting operations, and also enables an increase in the spacing of production wells, reducing at the same time the consumption of fluid per well sunk.

6 Claims, 6 Drawing Figures

METHOD OF OPENING CARBON-BEARING BEDS WITH PRODUCTION WELLS FOR UNDERGROUND GASIFICATION

The present invention relates to methods of developing carbon-bearing beds, and more specifically to methods of opening carbon-bearing beds with production wells for underground gasification. Preferably, the method disclosed is intended for use in the pitless development of coal, oil shale, various bituminous rocks and heavy petroleum. Apart from that, the method disclosed can find its application in the pit-less development of other mineral deposits by physical and chemical processes based on the gasification, metlting or leaching of the mineral.

The method disclosed can also be employed for opening up oil and gas fields by means of production wells and is suitable for tapping water-bearing strata with hydro-geological wells.

At present, there are known a great variety of methods of opening carbon-bearing beds with production wells for underground gasification. In one of the methods, the production well bore is drilled with a bit, using mud which is helpful in sealing off the well walls in the course of drilling and removing the drill chips to the surface. In said method, the production well is drilled some 3 to 5 m. short of the estimated depth of the bed top, the drill pipes and bit are withdrawn and the drilling of the bed is resumed with the aid of a bit with a diameter smaller than that of the bit used before. At this stage, the drilling takes place also in the presence of clay mud to a depth at least 5 m. below the bottom of the bed, and, on reaching said depth, the bit and the string of drill pipes are withdrawn. Next, the depth of the top and that of the bottom of the bed are determined, using some means of geophysical logging, before expanding the bore of the lower portion of the well so that it is equal to the bore of the upper portion down to a depth where it is intended to place the shoe of casing pipe string. On casing off the bore of the production well with a string of casing, the remaining portion of the well with a smaller bore between the shoe of casing string and the bottom of the bed is expanded, using a bit with a diameter somewhat smaller than the ID of the casing pipes.

In the known method, the drilling of the well for determining the depth of both the top and bottom of the bed is carried out with mud. Owing to the fact that the pressure of the mud in the well bore exceeds the hydrostatic head of the water in the carbon-bearing bed, mud penetrates the network of natural fissures along with easily permeable areas close to the face of the wall and seals off the well bore walls. This all interferes with the natural permeability of the bed and is an obstacle to the process of linking up the wells one to another by a fluid, if this process is possible at all. Sometimes, the wells can communicate at random, not in the desired way, with the result that the fluid reaches the top of the bed or permeable rocks occuring above the top of the bed.

Another disadvantage of the known method is high specific consumption of the fluid, which is, for example, air or oxygen-rich air or oxygen or water, being pumped into the well under a high pressure for connecting the adjacent wells. Furthermore, the necessity to sink production wells spaced closely one to another increases the total number of the wells drilled within the area intended for gasification. A further disadvantage of the known method is the necessity of performing lowering and lifting operations when replacing the main cross-section bit by the bit of smaller cross section and when expanding the bore of the well so as to give it the same diameter as the diameter of the main production well down to the depth where the shoe of casing pipe string is intended to be placed in the carbon-bearing bed.

Still another disadvantage of the known method is the necessity to use more than one bit of different diameter. The fact that the carbon-bearing bed is to be overdrilled into the basement rock by at least 5 m for the purpose of determining the depth at which the bed occurs has an adverse effect on the process of linking up the wells by means of a fluid and on the gasification itself.

It is an object of the present invention to eliminate said disadvantages.

Another object of the present invention is to facilitate and speed up the process of connecting the wells one to another by means of fluid through the body of the bed.

A further object of the invention is to reduce the specific consumption of the fluid.

Still another object of the present invention is to simplify the process of drilling and ease the task of determining the depth of both the top and bottom of the bed.

Said objects are attained by the fact that in a method of opening carbon-bearing beds with production wells which includes the drilling of wells, determining the depth at which a bed occurs and the fitting of a string of casing pipes, the production wells are drilled until the top of the bed is opened and on entering the upper portion of the bed the drilling is ceased, the depth of the top and that of the bottom of the bed are determined and then the drilling is resumed so as to leave a pillar of the layer at a depth whereat the communication between the adjacent wells by means of a fluid through the body of the bed is assured; after that a string of casing pipes is fitted in the well and the drilling of the pillar left between the shoe of the casing pipe string and the bottom of the bed goes on.

The disclosed method of opening carbon-bearing beds with production wells simplifies the opening technique in drilling production wells, adds to the effectiveness of the process of connecting adjacent wells one to another by means of a fluid through the body of the bed for its subsequent gasification and creates conditions for a more complete extraction of carbon-bearing beds. It also excludes the necessity of overdrilling the carbon-bearing bed below the bottom for logging by geophysical means and eliminates all the lowering and lifting of the drill pipes and bits for replacing the bit with one diameter by the bit of another diameter and expanding the well bore to the depth whereat the shoe of the casing pipe string is disposed.

It is expedient to determine, according to the invention, the depth of the bed top by gamma-ray logging, lowering the instrument for gamma-ray logging inside the string of drill pipes. The use of gamma-ray logging through the string of drill pipes allows undisturbed geophysical exploration within a mimimum interval of time.

It is preferred to drill said pillar of the bed between the shoe of casing pipe string and the bottom of bed with the use of a gaseous agent.

In another embodiment of the method disclosed, the drilling of the pillar of the bed between the shoe of casing pipe string and the bottom of bed is accomplished by using water.

The drilling wherein the pillar of the carbon-bearing bed left between the shoe of casing pipe string and the bottom of bed is opened in the presence of a gaseous agent permits retention of the natural permeability within said portion of the bed with the result that the specific consumption of the fluid is reduced in the course of connecting the adjacent wells through the body of the bed in its lowermost layer and the process of connection said wells is speeded up.

The present invention will be best understood from the following description of a preferred embodiment of the invention when this description is being read in conjunction with the accompanying drawings in which.

The drilling of the production wells for tapping carbon-bearing bed in accordance with the method disclosed can be accomplished by means of any drilling rig known at present capable of drilling wells with the diameter and depth of 250 to 400 mm and 300 to 400 m, respectively, or even more deeper wells.

The drilling rig commonly comprises a string of drill pipes 1 with a pit 2 attached to an end thereof and an arrangement (not shown) for feeding the pipes and bit into the face and rotating them therein. Before starting the drilling of a production well 3; there must be made available a plot prepared, for example, in course of prospecting to indicate the estimated depth at which a carbon-bearing bed 4 occurs. If the depth of both the top and bottom of the bed are known, the production well can be drilled fairly accurately with the possibility of monitoring the entrance of the bit into the carbon-bearing bed.

Figure 1:
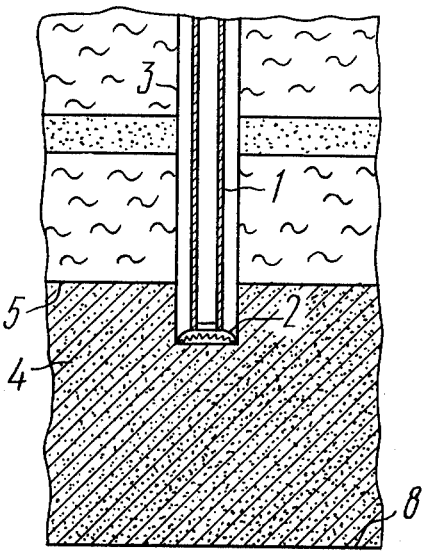
FIG. 1 shows a carbon-bearing bed tapped with a production well contained wherein is a bit which has entered the top portion of the carbon-bearing bed.

The drilling of the production well 3 in accordance with the method disclosed is carried on with the bit 2 of the selected diameter until the top of the carbon-bearing bed is tapped and mud is used during the drilling (FIG. 1). The fact that the bit 2 has met the top 5 of the carbon-bearing bed 4 becomes known because known is the depth at which the top 5 of the layer 4 is located, and this fact is ascertained by the drilling rate and the colour of the mud which changes as soon as the bit 2 enters the carbon-bearing bed 4.

Once the bit 2 has entered the carbon-bearing bed 4, the drilling is ceased. The depth of penetrating the carbon-bearing bed 4 by the bit 2 should be sufficient to assure the possibility of carrying out the gamma-ray logging required for determining the depth of the top of the carbon-bearing bed. Commonly the depth of penetrating the carbon-bearing bed 4 with the bit 2 varies over the range between 0.6 and 1.2 m.

On ceasing the drilling, an instrument 7 for gamma-ray logging suspended from a logging cable 6 is lowered into the string of drill pipes 1, said instrument being a widely known gauge for measuring natural radioactivity and recording the data, for example, on a paper tape.

Figure 2:
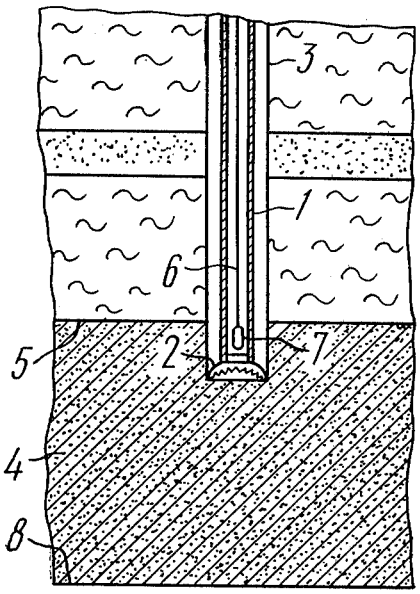
FIG. 2 shows a production well contained wherein are a string of drill pipes and an instrument for gamma-ray logging, said instrument being introduced into the string of drill pipes for determining the depth at which the top of the carbon-bearing bed occurs.

The readings of the instrument in conjunction with the length of the logging cable provide data which ascertains the exact depth at which the top 5 of the bed 4 occurs (FIG. 2).

It has been found that the natural radioactivity characteristics of carbon-bearing beds, for example coal beds, sharply differ from those of enclosing rocks commonly represented by sedimentary rocks such as sands and clays, limestones, marls and the like. In all cases, the natural radioactivity of enclosing rocks was higher than that of the carbon-bearing bed represented, for example, by brown and true coals.

Figure 3:
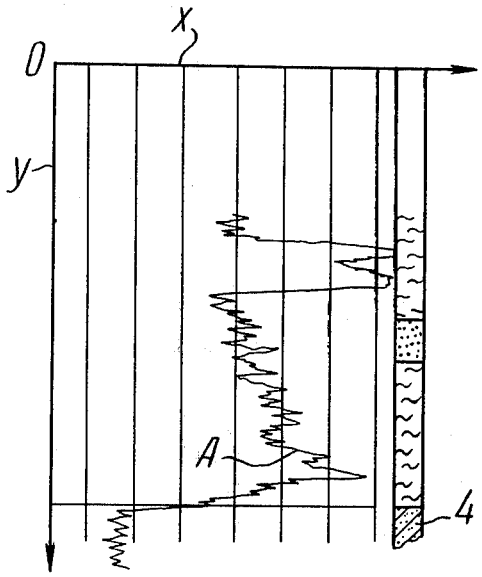
FIG. 3 shows a curve of natural radioactivity at the interface between a carbon-bearing bed and the enclosing rocks with mCi/hr plotted in the $x$-direction against the depth in meters in the $y$-direction.

Even with a certain allowance for the shielding effect of the drill pipes which are made of metal, distinctly visible on the curve of natural radioactivity A (FIG. 3) is the interface between the carbon-bearing bed 4 and the enclosing rocks. On locating the boundaries of the carbon-bearing bed from the readings of the instrument and on determining the depth of said boundary, the actual depth of the top of the carbon-bearing bed at each procution well can be obtained from the curve of natural radioactivity.

As the next step, the depth of the bottom 8 of the carbon-bearing bed 4 can be ascertained, using any means, particularly, by adding the thickness of the bed determined before to the known depth of the top of the bed.

Figure 4:
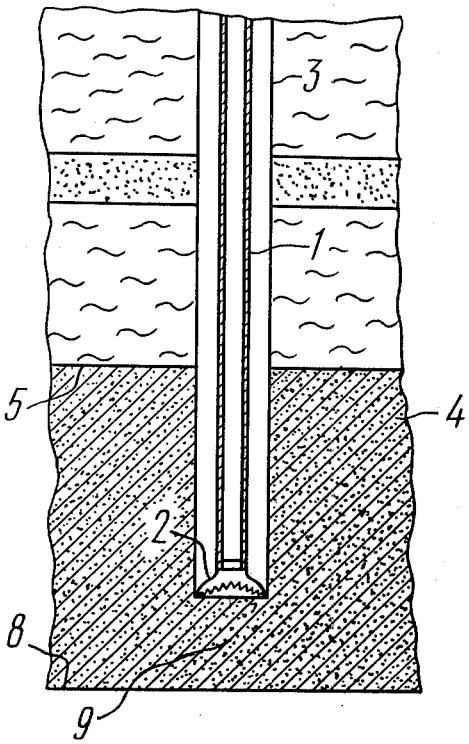
FIG. 4 shows a production well drilled to a depth whereat the shoe of drill pipe string is installed.

On acquiring the data on the depths whereat the top and the bottom of the bed are located, the drilling of the production well goes on to a depth wherefrom a pillar 9 is left between the tip of the bit and the bottom 8 of the bed 4 which is of a thickness assuring the possibility of communication between the adjacent wells (not shown) by means of a fluid through the body of the bed as indicated by the arrows in FIG. 4, said thickness varying between 0.6 and 2.0 m depending on the thickness of the carbon-bearing bed. After that the drilling is stopped and the drilling equipment withdrawn from the well.

As it will be noted, the drilling of the production well 3 down to the depth whereat a shoe 11 of a string of casing pipes 10 is to be disposed is accomplished in a single run, ascertaining the depth of the top of the carbon-bearing bed at the same time.

Figure 5:
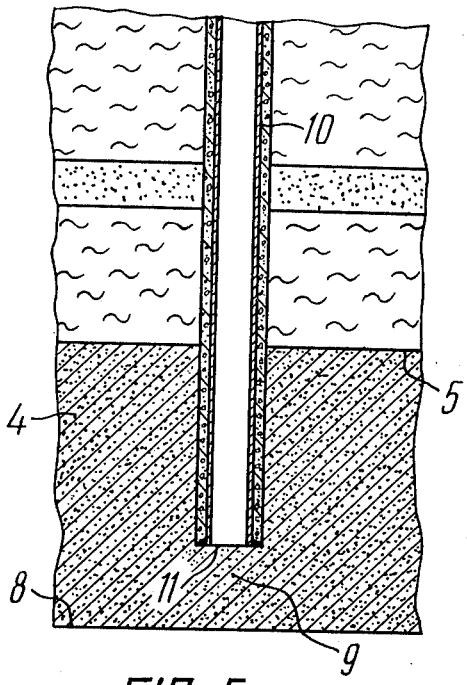
FIG. 5 shows a production well with a string of casing fitted thereinto.
Figure 6:
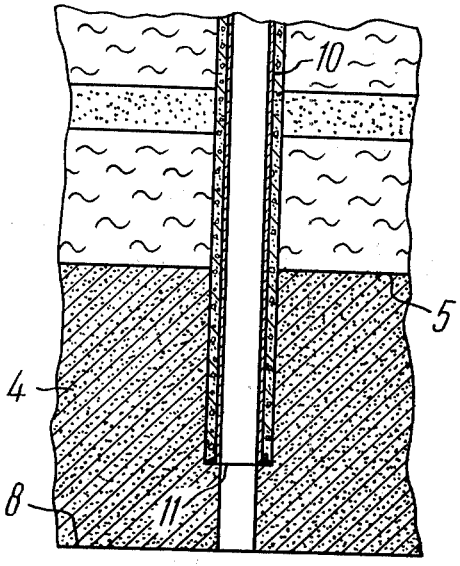
FIG. 6 shows a production well with the pillar of the bed between the shoe of drill pipe string and the bottom of bed drilled in the presence of a gaseous agent.

After installing the string of the casing 10 by conventional techniques (FIG. 5 ), the pillar 9 left between the shoe 11 of the string of casing 10 and the bottom 8 of the bed 4 is drilled in the presence of a gaseous agent (FIG. 6), using a bit with a diameter somewhat less than the I.D. of the casing pipes. In coping with this phase of drilling, the actual depth of the bottom 8 of the bed 4 can be ascertained, if necessary, by drilling with a core bit in the presence of a gaseous agent.

Here again, the drilling of the production well down to the depth whereat the shoe of the string of casing pipes is disposed is accomplished in a single run.

In case the invention disclosed is used, this effects a saving on the cost of drilling by 20%. shortens the period required for sinking a production well by 20 to 25% and reduces the number of the bit types used from three to two. Practical experience goes to show that the consumption of fluid per well connection is reduced 2 to 3 times of the amount used before. At the same time a two-fold increase in the spacing of the production wells is achieved, the total number of the wells drilled is reduced and the rate at which the wells communicate one with another by means of a fluid is increased by a factor of 2 to 3 or even higher. Since the connection of the wells one to another within the lower layer of the bed takes place in a directed manner, the deposit is extracted more completely and the recovery of the combustible components from a carbon-bearing bed can be as high as 90 to 100% of the total contents.

What is claimed is:

1. A method of opening carbon-bearing beds with production wells for underground gasification which includes the drilling of a production well until the top of a bed is opened, ceasing said drilling on entering the upper layer of said bed, determining the depths of both the top and bottom of said bed, resuming said drilling of said bed so as to leave a pillar portion of said carbon-bearing bed at a depth where the possibility of communication between the adjacent wells by means of a fluid is assured through the body of said bed, when said production well is completed with a cemented casing string down to the top of said pillar portion, cementing a string of casing in said well to the top of said pillar portion and drilling said pillar portion left between the shoe of casing pipe string and the bottom of said bed.

2. A method of opening carbon-bearing beds with production wells for underground gasification as claimed in claim 1, wherein the depth of said top of said bed is determined with the aid of gamma-ray logging, the instrument for gamma-ray logging being lowered into the string of drill pipes.

3. A method as claimed in claim 2, wherein the drilling of said pillar left between the shoe of said casing pipe string and the bottom of said bed is accomplished using a gaseous agent.

4. A method as claimed in claim 2, wherein the drilling of said pillar left between the shoe of said casing pipe string and the bottom of said bed is accomplished using water.

5. A method as claimed in claim 1, wherein the drilling of said pillar left between the shoe of said casing pipe string and the bottom of said bed is accomplished using a gaseous agent.

6. A method as claimed in claim 1, wherein the drilling of said pillar left between the shoe of said casing pipe string and the bottom of said bed is accomplished using water.

* * * * *